United States Patent [19]

Kniesser et al.

[11] Patent Number: 4,891,549

[45] Date of Patent: Jan. 2, 1990

[54] ELECTRON GUN SYSTEM

[75] Inventors: Karl Kniesser, Aichwald; Walter Kornaker, Ulm/Donau; Bernhard Lau, Elchingen; Werner Schanz, Esslingen-Zell, all of Fed. Rep. of Germany

[73] Assignee: Nokia Graetz, Pforzheim, Fed. Rep. of Germany

[21] Appl. No.: 52,714

[22] Filed: May 20, 1987

[30] Foreign Application Priority Data

May 23, 1986 [DE] Fed. Rep. of Germany ..... 3617432

[51] Int. Cl.[4] ..... H01J 29/52

[52] U.S. Cl. ..... 313/414; 313/448

[58] Field of Search ..... 313/414, 417, 447, 448

[56] References Cited

U.S. PATENT DOCUMENTS

| | | | |
|---|---|---|---|
| 4,319,160 | 3/1982 | Say | 313/458 |
| 4,500,808 | 2/1985 | McCandless | 313/447 X |
| 4,661,741 | 4/1987 | Valun et al. | 313/447 |

FOREIGN PATENT DOCUMENTS

| | | | |
|---|---|---|---|
| 0045547 | 9/1984 | European Pat. Off. . | |
| 3018569 | 3/1984 | Fed. Rep. of Germany . | |
| 54-117677 | 12/1979 | Japan | 313/447 |

*Primary Examiner*—Kenneth Wieder

*Attorney, Agent, or Firm*—Peter C. Van Der Sluys

[57] ABSTRACT

The electron gun system of a color picture tube has coined depressions in the area of the apertures for the electron beams in at least one grid electrode, the coined depressions in one side of the grid electrode being concave. Preferably, this is the side of the grid electrode facing the cathode.

7 Claims, 1 Drawing Sheet

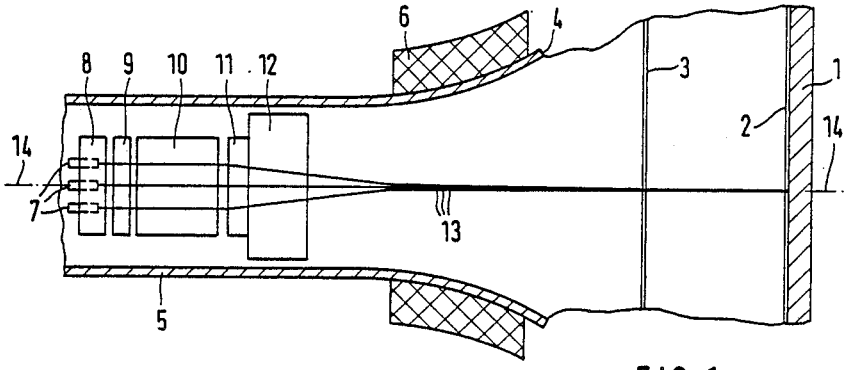
FIG. 1
FIG. 2
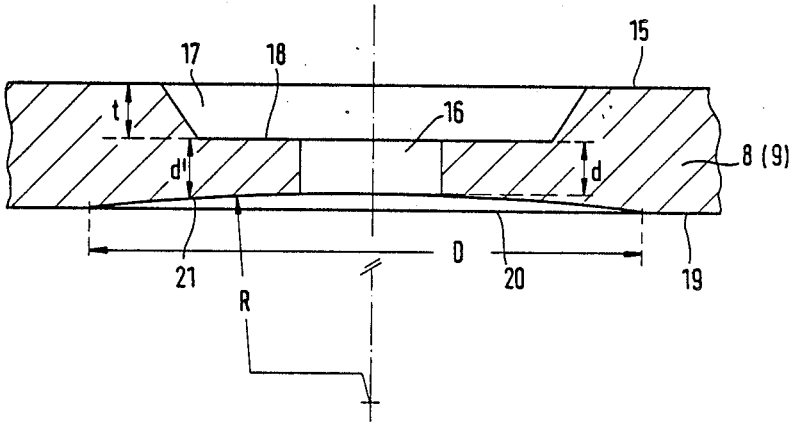
FIG. 3
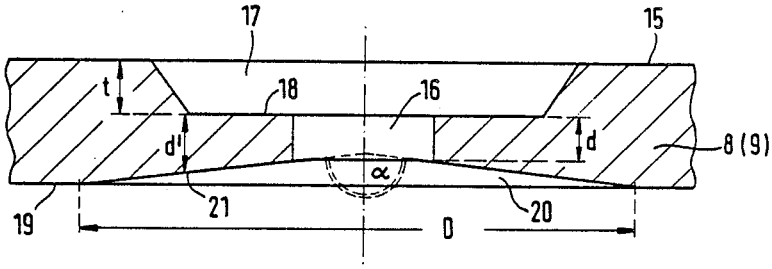

ELECTRON GUN SYSTEM

BACKGROUND OF THE INVENTION

1. Field of the Invention

The present invention relates to an electron gun system for color picture tubes and more particularly to a gun system having at least one grid electrode having coined depressions on its sides in the area of the apertures for the electron beams.

2. Description of the Prior Art

European Pat. No. B-45,547 discloses an electron gun system of the above kind which has at least two grid electrodes. At least one of the grid electrodes has coined depressions on both sides in the area of the apertures for the electron beams. The coined depressions are produced on both sides, essentially at the same time, and their surfaces are parallel in relation to each other and in relation to the surfaces of the grid electrode. When coining such grid electrodes, the resulting pressure is so high that the coining tools can break or have only a very short tool life.

SUMMARY OF THE INVENTION

It is an object of the present invention to provide an electron gun system of the above kind in which the grid electrodes are designed so as to permit a more cost-effective production.

This more cost-effective production is achieved by forming at least one of the coined depressions with a concave surface. The concave surface advantageously has a radius of about 10 to 30 mm and said surface faces the cathode.

In another embodiment the coined depressions have the shape of a truncated cone with a taper angle of almost 180°.

With grid electrodes for electron gun systems designed in this manner, the load on the coining tools is kept within economically justifiable limits, and the tool life is acceptable.

BRIEF DESCRIPTION OF THE DRAWINGS

FIG. 1 is a horizontal section of part of a color picture tube.

FIG. 2 is a section through a grid electrode showing a first embodiment.

FIG. 3 is a section through a grid electrode showing a second embodiment.

DESCRIPTION OF THE PREFERRED EMBODIMENTS

For the sake of clarity, a section of only part of a color picture tube is shown in FIG. 1. The section is taken along the horizontal axis of the color picture tube. The color picture tube comprises a faceplate 1 with a screen 2 applied to its inside surface, a shadow mask 3 mounted in front, and an envelope 4 which passes into a tube neck 5. A deflection yoke 6 is mounted on the tube neck which contains the electron gun system.

The electron gun system has three cathodes 7 surrounded by grid electrodes 8, the Wehnelt cylinders. The following screen grid electrodes, the focus electrodes and the anodes bear the reference numerals 9, 10, and 11, respectively. They are followed by a convergence cup 12. The electron gun system can consist of separate electron guns, or of in-line guns. It is advantageous to design separate electrodes of the system so that they can be joined into each other like in a telescope. The usual glass beads to hold the electron gun system are not shown. The number of electrodes in each electron gun system is not restricted to four. The electron beams produced by the electron gun system bear the reference numeral 13. Only the left and the right ends of the tube axis 14, which represents the symmetry axis of the color picture tube, are shown.

FIG. 2 is a section through part of a grid electrode 8 or 9. A side 15 facing the screen 2, has a rectangular coined depression 17 in the area of the aperture 16 for the electron beam. Depression 17 has a trapezoidal cross section with a base surface 18 parallel to the side 15 and a depth t.

On a side 19 of the grid electrode 8 or 9 which faces the cathodes 7, there is a coined depression 20 opposite the coined depression 17. This coined depression is circular and has a diameter D. The base surface 21 of the coined depression 20 is concave with a radius R of about 10 to 30 mm. The two base surfaces 18 and 21 have a distance d from each other. The center of the concave coined depression 20 lies on the axis of the aperture 16.

Owing to this design of the coined depression 20, the material of the electrode 8 or 9 can flow off more easily in the area of the aperture 16 in the outward direction during coining. Thus, less pressure results during coining and the coining tool is not subjected to such a high load.

Instead of being designed concave, the coined depression 20 can also have the shape of a truncated cone as shown in FIG. 3. The taper angle of the truncated cone shown in the drawing is slightly smaller than 180°. Other designs of the coined depression 20 are also possible; it is important, however, that the distance d between the base surfaces 18 and 21 near the aperture 16 be smaller than at the edge of the coined depression 17, where the distance is designated as d'.

The coined depression 17 may also have the concave design or the design in the shape of a truncated cone, the coined depression 20 then being rectangular.

What is claimed is:

1. An electron gun system for a color picture tube, comprising:

at least one grid electrode having coined depressions on two opposing surfaces, said depressions being formed about an aperture formed for an electron beam, said coined depression in one surface of the grid electrode being formed with a continuous surface extending in all directions about said aperture, from an edge of said aperture to the electrode surface.

2. An electron gun system as described in claim 1, wherein the continuous surface is a conical surface.

3. An electron gun system as claimed in claim 1, wherein the continuous surface is a curved surface.

4. An electron gun system as described in claim 2, wherein the conical surface is formed about an axis of said aperture and has an included angle slightly less than 180°.

5. An electron gun system as described in claim 3, wherein the curved surface is a spherical surface having a radius of between 10 to 30 millimeters.

6. An electron gun system as described in claim 1, wherein the continuous surface is formed on a surface of the grid electrode which faces a cathode of the electron gun system.

7. An electron gun system as described in claim 1, wherein a plurality of electrodes are provided for forming a plurality of electron beams, and each electrode has a like plurality of apertures with coined depressions formed about each aperture.

* * * * *